US006892876B1

(12) United States Patent
Aubry et al.

(10) Patent No.: US 6,892,876 B1
(45) Date of Patent: May 17, 2005

(54) CONTAINER HAVING SLIDE PANEL WITH SEPARABLE PORTION

(75) Inventors: Bethany A. Aubry, Rochester, NY (US); Dennis Bacchetta, Webster, NY (US); Lesley Bethune-Bates, Rochester, NY (US); MaryAnn Hussar, Henrietta, NY (US); Mark McOmber, Penfield, NY (US); Lisa V. Palvino, Rochester, NY (US); David Rydell, Pittsford, NY (US); Thomas Simmons, Rochester, NY (US); Scott D. Sylvester, Basom, NY (US); David Ziemba, Avon, NY (US)

(73) Assignee: Diamond Paper Box Co., Inc., Rochester, NY (US)

( * ) Notice: Subject to any disclaimer, the term of this patent is extended or adjusted under 35 U.S.C. 154(b) by 0 days.

(21) Appl. No.: 10/714,007

(22) Filed: Nov. 14, 2003

(51) Int. Cl.[7] ..... B65D 69/00

(52) U.S. Cl. ..... 206/232; 206/758; 206/767; 206/831

(58) Field of Search ..... 206/232, 449, 206/450, 459.5, 472, 45.28, 45.29, 758, 759, 767, 813; 229/118; 40/124.08, 310, 312, 488, 491

(56) References Cited

U.S. PATENT DOCUMENTS 3,625,412 A * 12/1971 Rosenburg, Jr. ..... 206/831
4,413,730 A 11/1983 Morse
4,620,664 A * 11/1986 Kaufman et al. ..... 206/831
5,259,133 A 11/1993 Burtch
5,341,923 A 8/1994 Arasim
5,433,317 A 7/1995 Roser
5,450,680 A 9/1995 Bromberg
5,479,732 A 1/1996 Burtch et al.
5,497,876 A 3/1996 Fleming
5,608,977 A 3/1997 Burtch et al.
5,611,161 A 3/1997 Murphy
5,860,589 A * 1/1999 Hsu ..... 206/232
5,901,844 A 5/1999 Gambardella et al.
6,053,325 A 4/2000 Yonker et al.
6,059,101 A 5/2000 Gambardella et al.
6,393,707 B1 * 5/2002 Maffei ..... 206/232

* cited by examiner

*Primary Examiner*—Luan K. Bui
(74) *Attorney, Agent, or Firm*—Brian B. Shaw, Esq.; Roger Aceto, Esq.; Harter, Secrest & Emery LLP

(57) ABSTRACT

A thin generally rectangular package for containing a farinaceous product such as dry mixes, cereals and the like including a portion that is removable from the carton with out opening or destroying the integrity of the package. The removable portion is contained on a slide that is sandwiched between a flat side of the carton and a panel fixed to the flat side. The slide is tethered to the flat side by a portion of the panel arranged to buckle outward from the plane of the flat side when the slide is pulled from between the flat side and the panel.

19 Claims, 10 Drawing Sheets

CONTAINER HAVING SLIDE PANEL WITH SEPARABLE PORTION

CROSS-REFERENCE TO RELATED APPLICATIONS

NONE.

STATEMENT REGARDING FEDERALLY SPONSORED RESEARCH OR DEVELOPMENT

Not Applicable.

REFERENCE TO A "SEQUENCE LISTING"

Not Applicable.

BACKGROUND OF THE INVENTION

1. Field of the Invention

The invention relates generally to packaging for food products and the like and more particularly to such a package incorporating a removable portion that can be archived.

2. Description of Related Art

A common sight on a grocer shelf is a generally thin, upright rectangular box containing a farinaceous product such as flours and other cereal grains, dry mixes for making baked items, ready-to-eat breakfast cereals, cereal mixes and other food items and pet foods, among others. The outer surface of the box (and sometimes even the inner surface) is generally covered with advertising, descriptive and nutritional information, promotional items such as coupons, a collectable item, a game card or instructional information such as recipes and the like.

Some of the information on the box such as recipes, coupons or a collectable item can be saved for future use and to do so, the consumer has to cut the relevant portion from the container. As cutting compromises the integrity of the container and possibly destroys the container, the consumer generally has to wait until the contents are consumed before retrieving the desired information. In other cases, a manufacturer will package an item such as a card having the relevant information in clear plastic and then add this to the contents of the container. While this makes the relevant information accessible without destroying the container, the addition of a foreign object into the food item is not desirable. Also, in cases where the item is inside the box, the consumer cannot examine the item prior to purchase.

Accordingly, it is an object of the present invention to provide a package having a portion that can be easily removed and archived.

Another object is to provide a package having a portion that is removable without accessing or otherwise compromising the integrity of the container.

Still another object is to provide a package having a portion that can be extended from a concealed position for examination and then returned to the concealed position without destroying the integrity of the package.

A further object is to provide a package having a slide panel with a separable portion that is removable from the container without compromising the integrity of the container.

Yet another object is to provide a blank for forming a container including an integral slide portion having a separable portion.

BRIEF SUMMARY OF THE INVENTION

The package of the present invention comprises a parallelepiped carton defining an enclosed volume. Preferably, and as is common in the art, the carton is generally the shape of a thin rectangular solid having major panels forming the front and back of the carton and smaller minor panels forming the opposite sides of the carton. The top and bottom of the carton comprise one or more flaps that overlap to close the carton. The top flaps may include elements such as a slot and a tap allowing the carton to be resealed after opening.

Provided preferably on one of the major panels are two additional panels including a slide panel. The slide panel is in a concealed position and can be extended from the footprint of the major panels to form a display panel. The slide panel includes a line of perforations allowing for the easy separation and removal of a portion of the slide panel. The removable portion includes the recipe, coupon, collectable or other indicia that the consumer intends to retain after the carton is discarded.

If the consumer does not need or intend to separate the removable portion, the slide panel can be returned to the concealed position. Moving the slide panel between the concealed and display positions can be repeated as desired by the consumer.

The present invention further provides a blank for forming a package having a slide panel with a separable portion. In particular the blank has a first portion provided with orthogonal score and fold lines defining panels that are foldable to form a rectangular carton having a front, back, opposite sides, a top and a bottom. Preferably the panels defining the front and back of the carton have a larger footprint than either the opposite sides, the top or the bottom. As known in the art, the portions of the blank forming the top of the carton can include the appropriate tabs and slots that permit the carton to be resealed or closed after opening.

Attached to the first portion is a slide-forming portion including a major panel connected to the first portion along a fold line that defines a first side edge of the carton and a minor panel that is connected to the major panel along a fold line that corresponds to a first bottom edge of the carton. The major panel is generally the size of the footprint of the front and back of the carton and the minor panel is narrower than the footprint of the carton front and back.

The major panel has two parallel cuts extending inward from the fold line corresponding to the first bottom edge. The cuts are parallel to the fold line corresponding to the side edge of the carton and extend inward to transverse fold line.

The minor panel has at least one transverse line of perforations extending generally parallel to the fold line corresponding to the first bottom edge so that at least one portion of the minor panel can be removed. The removable portion is printed with the indicia representing a recipe, coupon, collectable or other information that the consumer intends to save.

The present invention provides a product package with a removable display panel, the package having a flat side with an interior surface and an exterior surface. Disposed and tethered to the exterior surface of the flat side is a slide panel, the slide panel being slidable along an axis of the package in a plane parallel to the plane of the flat side between a first position laying within the foot print of the flat side and a second position exposing a portion of the slide panel out from the foot print of the flat side. The slide panel further has a line of weakness extending in a direction transverse the axis of the package facilitating the separation of at least a part of the exposed portion of the slide panel from the flat side.

Accordingly, the present invention may be characterized by a product package with a removable display panel comprising:

a) a sealable package sized to encompass a product, the package having a flat side with an interior surface and an exterior surface;

b) a slide panel disposed against the exterior surface of the flat side, the slide panel having an end tethered to the exterior surface and a free end, and the slide panel being slidable along an axis of the package in a plane parallel to the plane of the flat side between a first position laying within the foot print of the flat side and a second position exposing a portion of the slide panel out from the foot print of the flat side; and c) the slide panel having a line of weakness extending in a direction transverse the axis of the package, the portion of the slide between the line of weakness and a free edge of the slide comprising a removable portion and the line of weakness facilitating the separation of the removable portion of the slide panel from the flat side.

In another aspect, the present invention may be characterized by a blank for a paperboard container having a removable display portion comprising:

a) a first portion cut and scored with orthogonal fold lines to define panels that are foldable to form a rectangular carton having a front, back, opposite sides, a top and a bottom;

b) a second portion including a major panel connected to the first portion along a fold line that corresponds to a side edge of the carton and a minor panel connected to the major panel along a transverse fold line that corresponds to a first bottom edge of the carton, the major panel being of a size generally consistent with the footprint of the front and back of the carton and the minor panel being narrower than the footprint of the front and back of the carton;

c) the major panel including two cuts extending inward from the transverse fold line and parallel to the fold line corresponding to a side edge of the carton, the cuts terminating in a second transverse fold line; and d) the minor panel having at least one transverse line of perforations extending generally parallel to the fold line corresponding to the first bottom edge.

BRIEF DESCRIPTION OF THE SEVERAL VIEWS OF THE DRAWING(S)

DETAILED DESCRIPTION OF THE INVENTION

Figure 1:
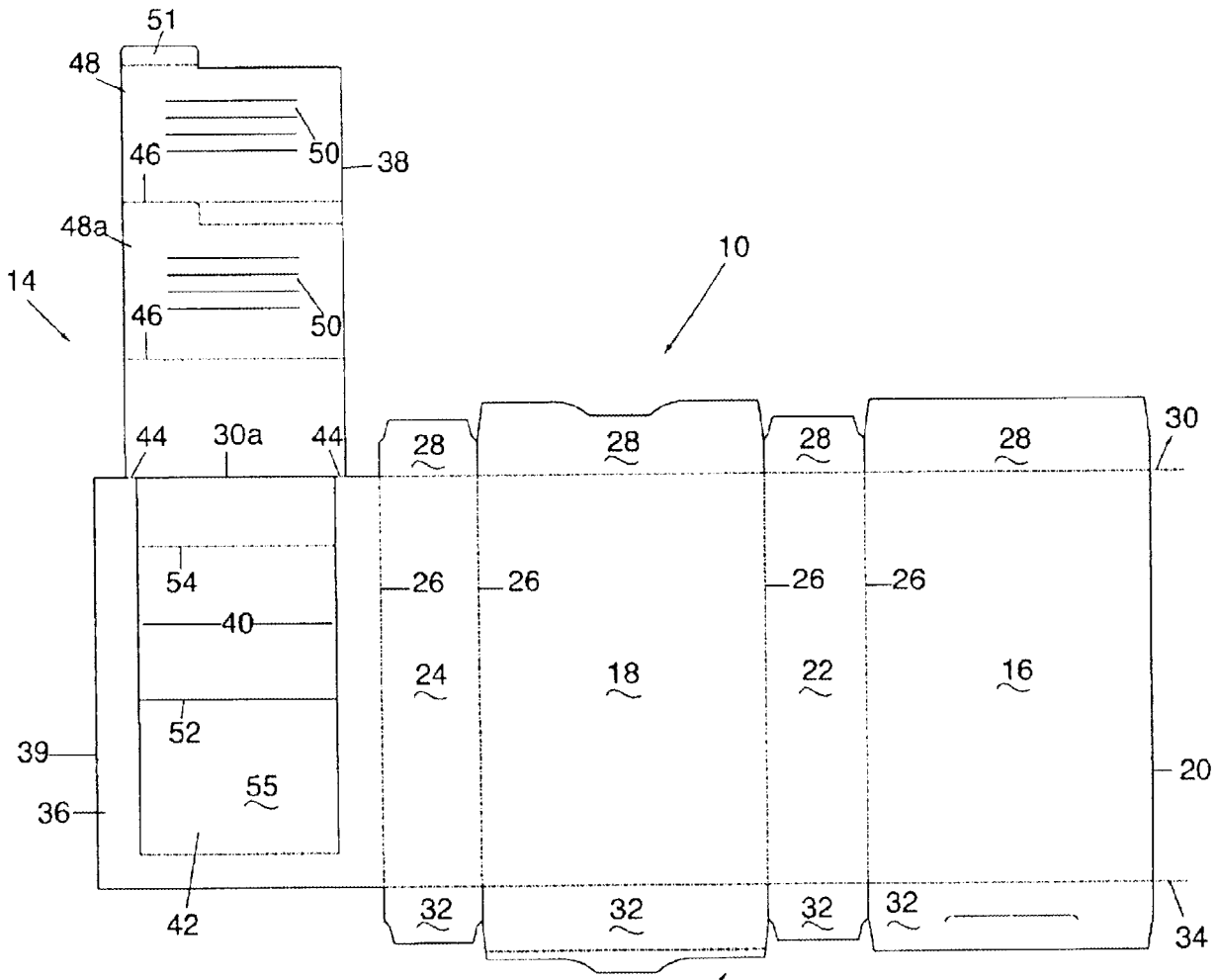
FIG. 1 is a plan view of a blank of the present invention.

Referring to the drawings, FIG. 1 shows a paperboard or cardboard blank generally indicated at 10 to include a first portion 12 that forms an enclosed carton or package and a second portion 14 that forms a slide panel with a removable portion. The first portion 12 is conventional in that it is cut and scored to form a foldably connected panels that are formable into a generally rectangular package of a size and shape commonly used for the packaging of dry mixes, cereal grains, breakfast cereals and the like.

In particular the first portion 12 of the blank includes a first major carton panel 16 including a free edge 20, a second major carton panel 18 and two narrower carton panels 22, 24 all connected by fold lines 26. The two major carton panels 16, 18 correspond to the front and back of the carton and the two narrower panels 22, 24 correspond to the opposite sides of the carton. Accordingly, as shown, the free edge 20 and the fold lines 26 correspond to the side edges of the carton when the blank is folded.

The blank further includes one or more bottom forming tabs 28 connected to the panels 16, 18, 22, 24 along an orthogonal fold line 30 that corresponds to the bottom edge of the carton when the blank is folded. It is to be understood that the fold lines as described herein may be impressed or scored to facilitate folding.

One or more top forming tabs 32 are connected to the panels 16, 18, 22 and 24 at the opposite side of the blank along an orthogonal fold line 34 that forms the top edge of the carton when the blank is folded. While not shown, it is understood that the tabs 32 may be cut and scored as is known in the art to provide structure that allows the top to be resealed after the carton is opened.

The second portion of the blank includes a third major panel 36 that has a footprint generally consistent with the size and shape of the first and second carton panels 16,18 and a slide panel 38 that is connected to and extends from the third major panel. The major panel 36 (and therefore the slide panel 38) is connected to the first portion of the blank along one of the fold lines 26 and has a free edge 39. The slide panel 38 extends from the third major panel 36 at a fold line 30*a* that is the fold line 30 extended.

The third major panel 36 has two parallel cuts 40 extending inward from the fold line 30*a*. The cuts extend parallel to the fold lines 26 and terminate at a transverse fold line 42 that extends parallel to the fold line 34. The two parallel cuts and transverse fold line 42 define a free section 55 of the major panel. In addition, two transverse cuts 44 extend along the fold line 30*a* outwardly from each of the parallel cuts 40. The two transverse cuts 44 separates the slide panel 38 from the third major panel. They also free the section 55 and allow the section to separate and move out from the plane of the third major panel 36 so the slide panel and the section 55 are free to fold relative to the third major panel.

As shown in FIG. 1, the slide panel 38 is narrower than the major panel 36 but wider than the distance between the two cuts 40. One or more lines of perforations 46 extend across the slide panel to facilitate the separation and removal of portions of the slide panel. The line of perforation can include scoring, laser scoring, weakening as well as perforations. Each of these portions, indicated at 48 can be provided with indicia 50 representing recipe instructions, coupon information, a collectible image or the like. If the removable portion contains recipe instructions, the size of each removable portion 48 preferably is the size of an index card so the removed portion can be retained in a file box. In any event if appropriate, an outer edge of the slide panel is provided with a tab 51 that is useful as a file index tab.

To complete the structure of the blank, FIG. 1 shows that the portion of the third major panel 36 between the cuts 40 includes two additional transverse fold lines 52, 54 with the fold line 52 being midway between fold lines 42 and 54.

Figure 2:
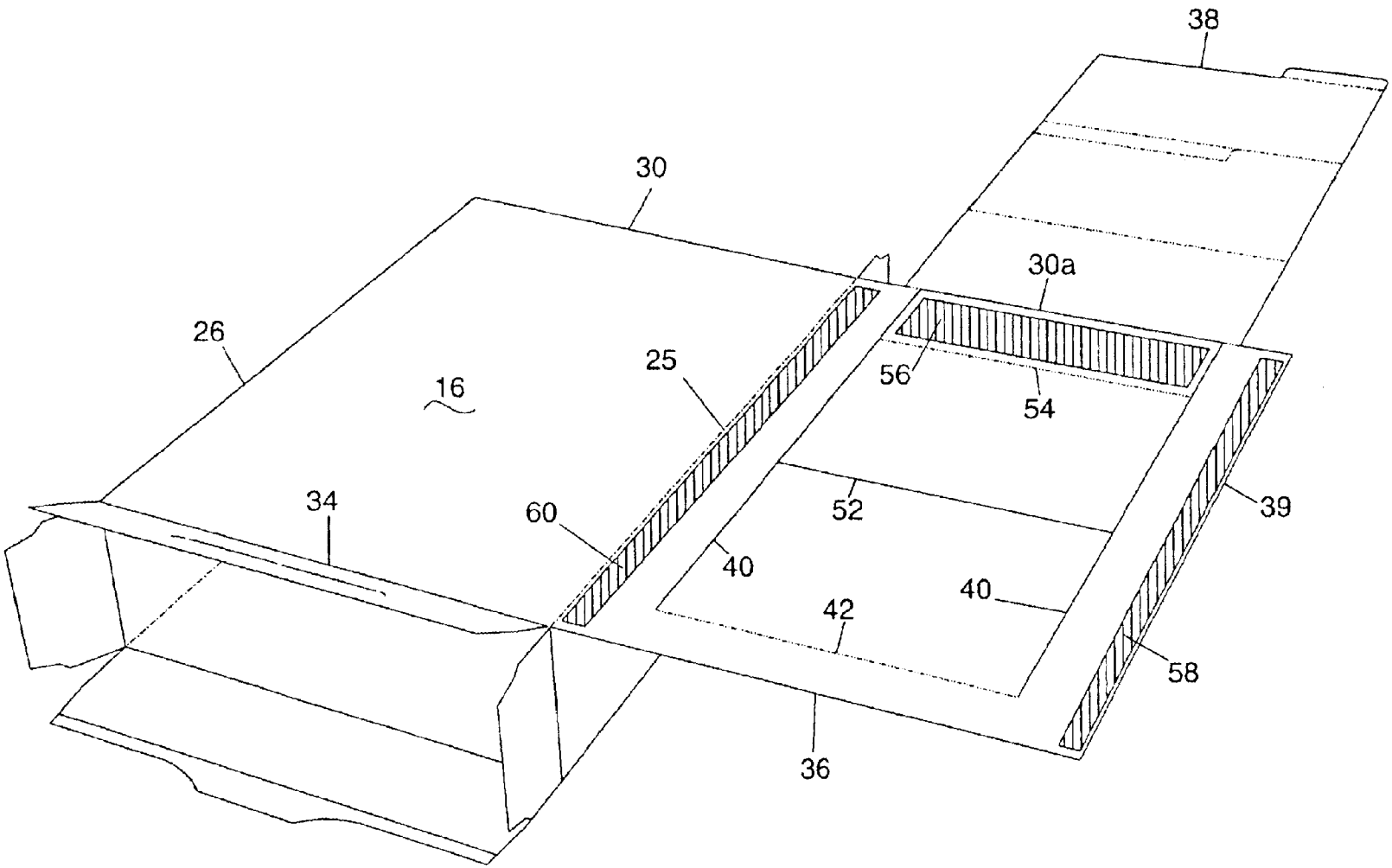
FIG. 2 is a perspective view showing a partly assembled carton lying on its face.

To assemble the carton, an adhesive (not shown) is applied to portions of one of the first or second major panels 16, 18 and tabs 28, 32. The panels, 16, 18, 22, 24 and tabs 28 of the first portion 12 of the blank are folded to form a rectangular carton as shown in FIG. 2. The tabs 32 are not closed until after the carton is filled.

An adhesive also is applied to portions of the slide-forming portion 14 of the blank. In this respect as shown FIG. 2, an adhesive applied to the area of the third major panel 36 between the fold lines 30*a* and 54 indicated at 56. An adhesive further is applied to portions of the panel 36 along the free edge 39 and the fold line 26 as indicated at 58 and 60 respectively. The adhesive 58,60 does not extend inward to the width of the slide panel 38 so the slide panel can be folded flat against the panel 36 with out contacting the adhesive 58, 60.

Figure 3:
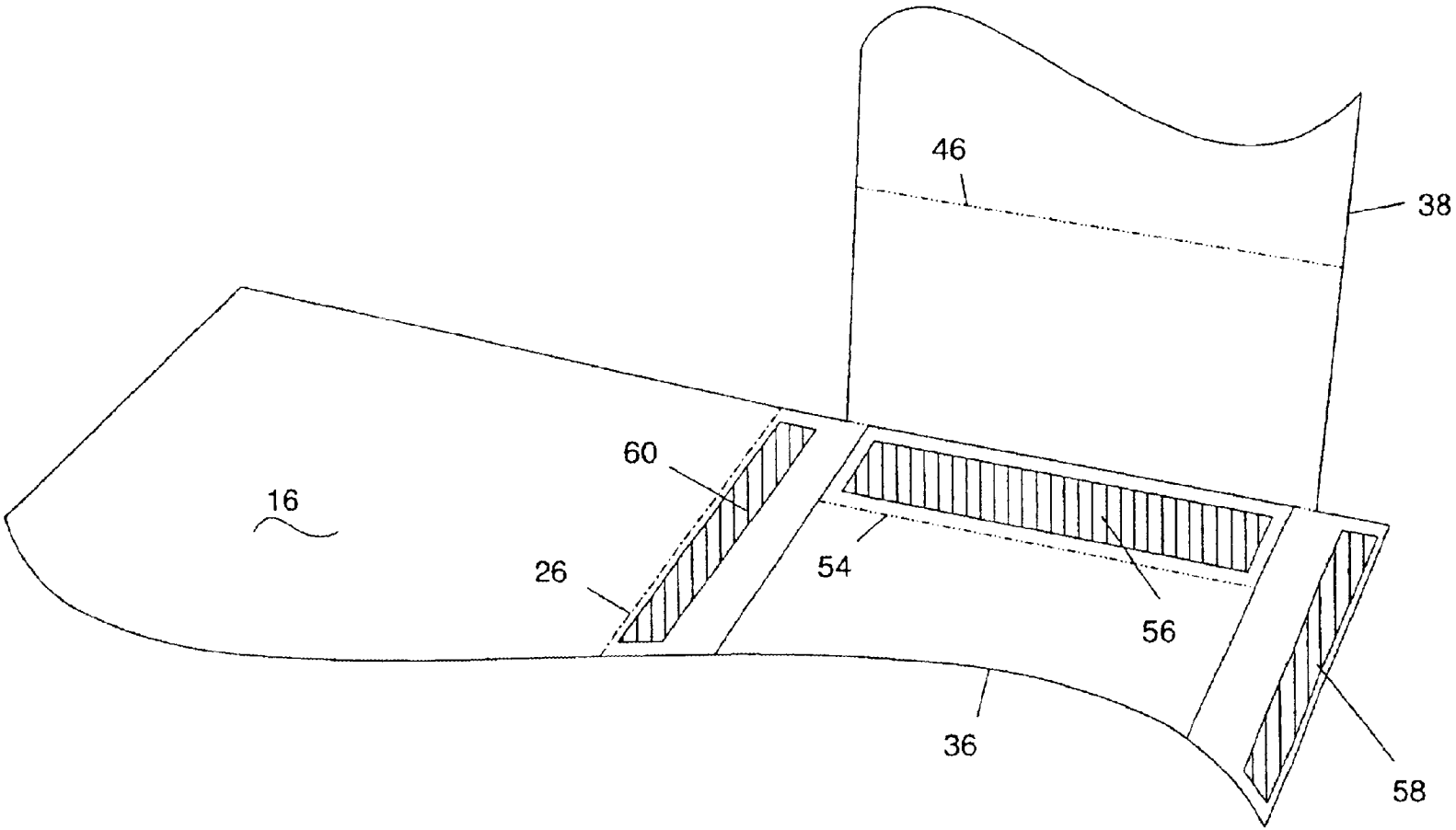
FIG. 3 is a perspective view showing another step in the construction of the carton.
Figure 4:
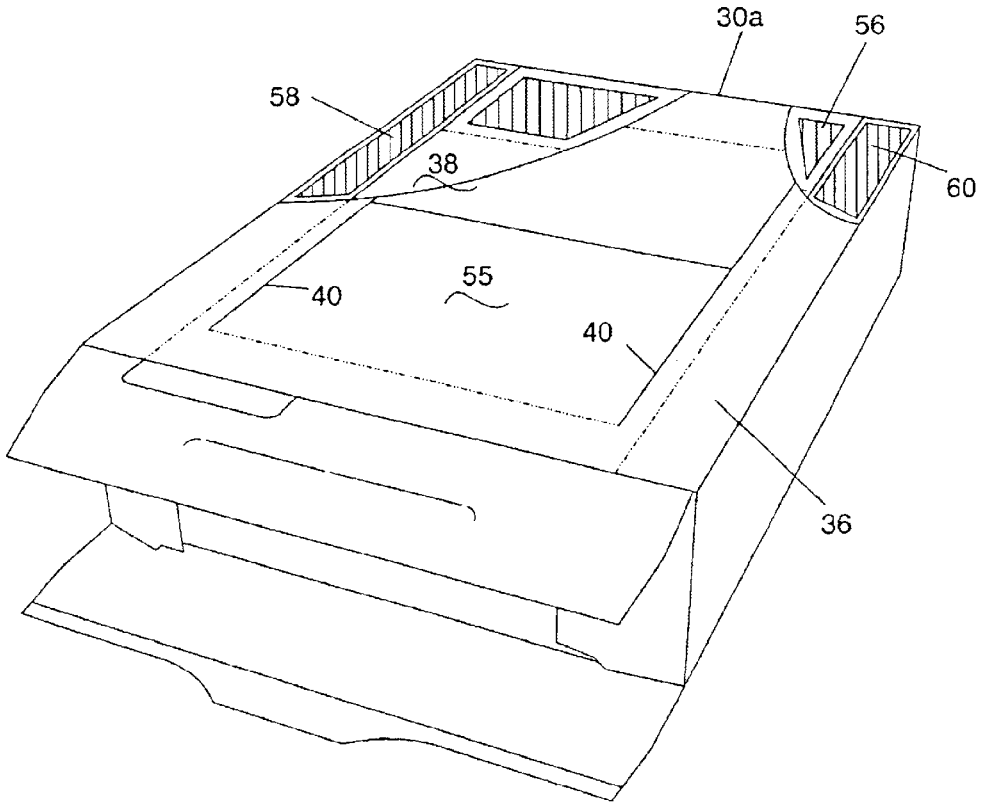
FIG. 4 is a perspective view of an assembled carton lying flat on its face.

The slide panel 38 is then folded up and over the third major panel 36 (FIG. 3) until it lays flat on the panel. This adheres the slide panel to the portion of the third major panel 36 in the area of the adhesive 56. The third major panel 36 then is folded along the fold line 26 up and over the first major panel 16. This sandwiches the slide panel 38 between the two major panels 16 and 36 wherein the adhesive 58,60 fixes the two panels 16, 36 together as shown in FIG. 4.

In the context of the present invention, the third major panel 36 represents an external panel of the assembled carton. Also, the arrangement as described, allows the slide panel 38 to move relative to the carton wherein the section 55 of the third major panel tethers the slide to the surface of the assembled container (the section 55 being connected to the third major panel 36 along the fold line 42 and the third major panel being adhered to the carton panel 16).

Figure 6:
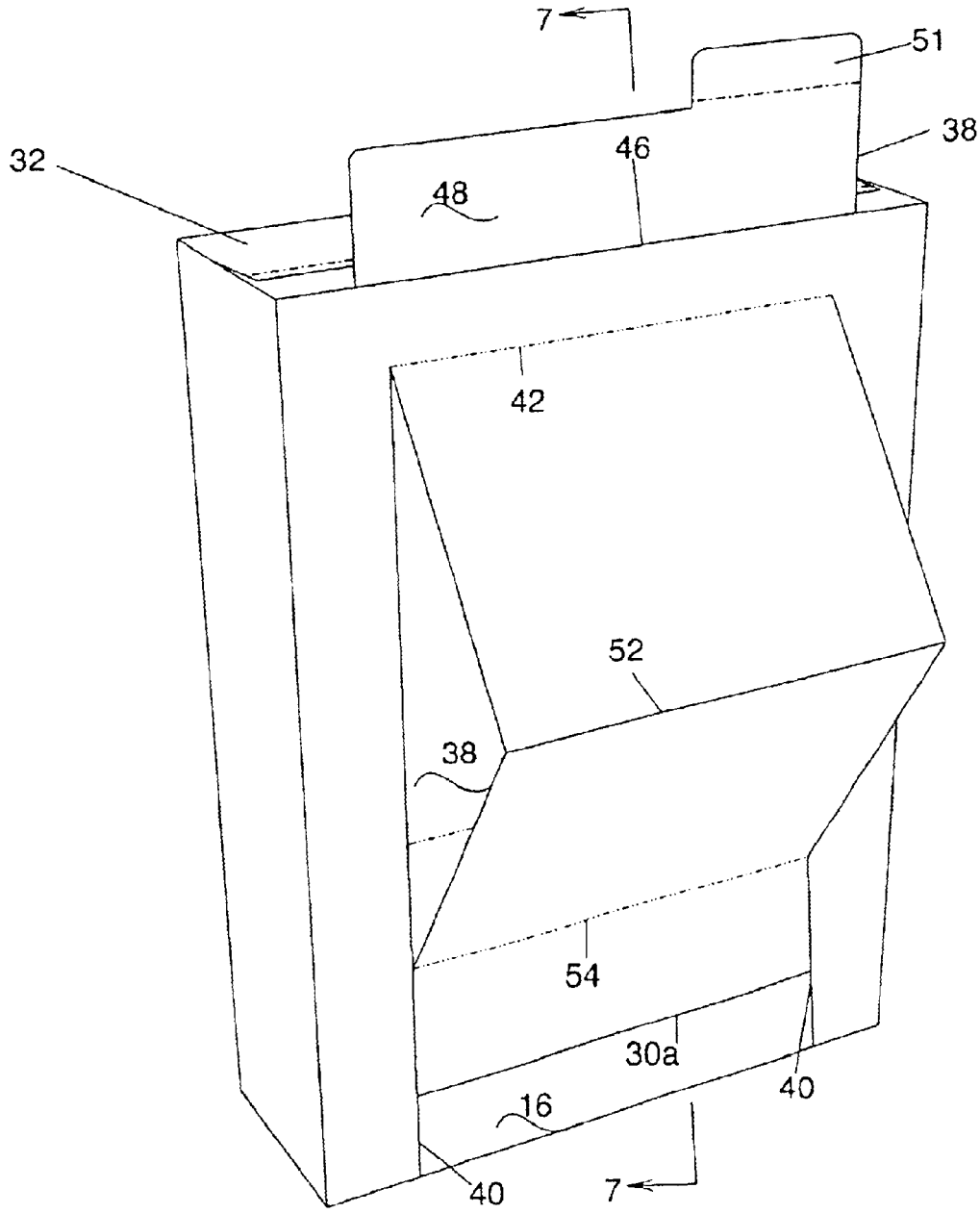
FIG. 6 is a view similar to FIG. 3 showing the sliding panel partly extended.

The carton, now assembled can be stood upright, filled and the top tabs 32 folded and sealed to close the carton as shown in FIG. 6.

Figure 7:
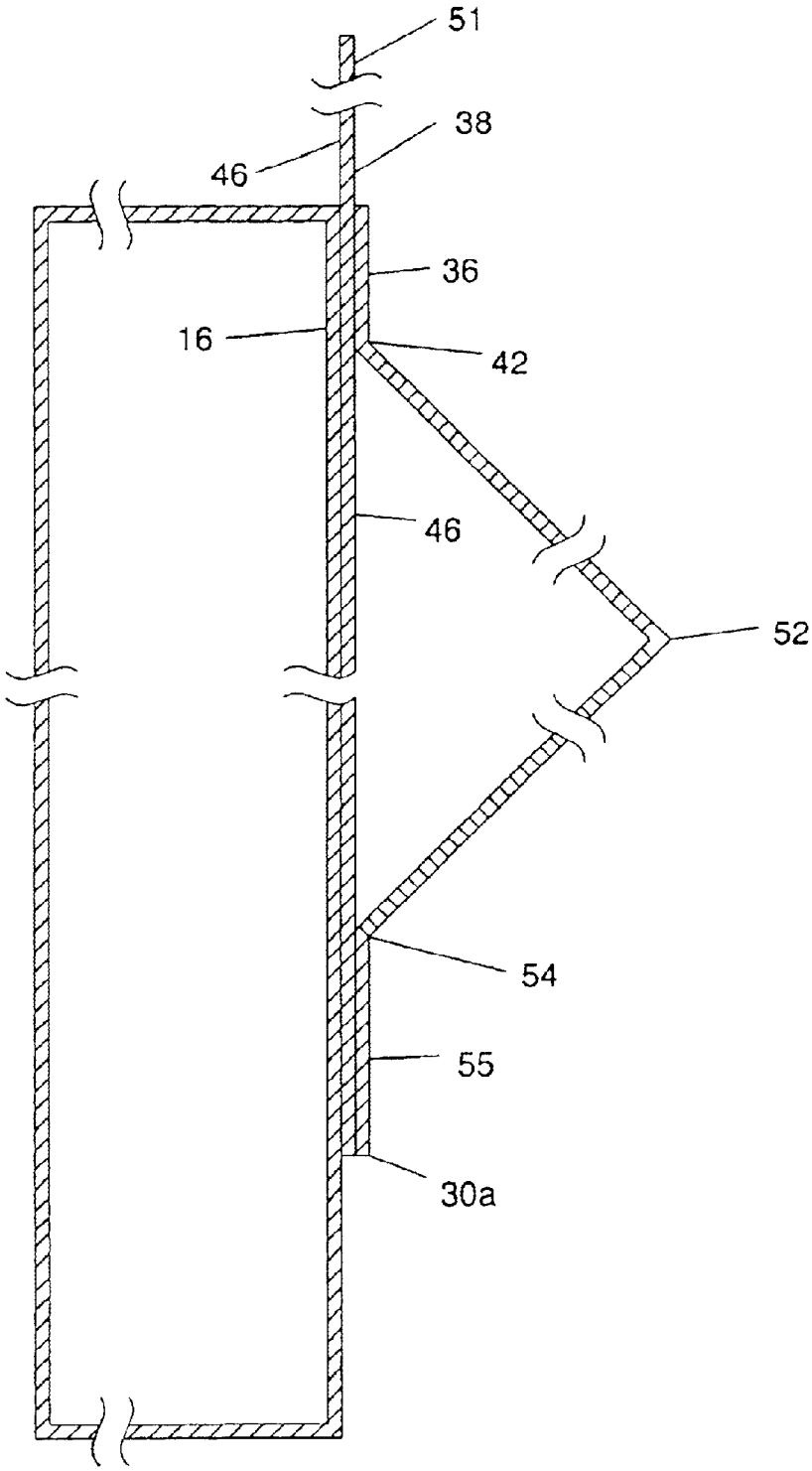
FIG. 7 is a sectional view on an enlarged scale taken along lines 7—7 of FIG. 6.

In use, as show in FIGS. 6 and 7, the file tab 51 at the top or free end of the slide panel 38 is pulled to extend the slide panel 38 up from between the first and third panels 16, 36. The section of the major panel 36 as indicated at 55 that lies between the two cuts 40 buckles outward and collapses by folding along the fold lines 42, 52 and 54 as the slide panel is pulled up. The slide panel cannot be pulled completely out from under the major panel 36 because as noted above, the slide panel is tethered to the exterior surface of the flat side 16 of the carton.

Pulling the slide panel up exposes a first portion 48 that can be torn away along the line of perforations 46 and removed. Continued pulling will expose a second portion 48*a* (FIG. 1) that also can be removed. Rather than removing a portion of the slide panel, the slide panel 38 can be push down to return it to the position shown in FIG. 5.

It is important to note that the information on the slide panel can be exposed and examined without opening the package. Also, one or more of the portions 48 can be removed without destroying the integrity of the carton. This allows a consumer to reseal the carton after partial use of the contents, while still being able to remove a portion of the slide panel.

Figure 5:
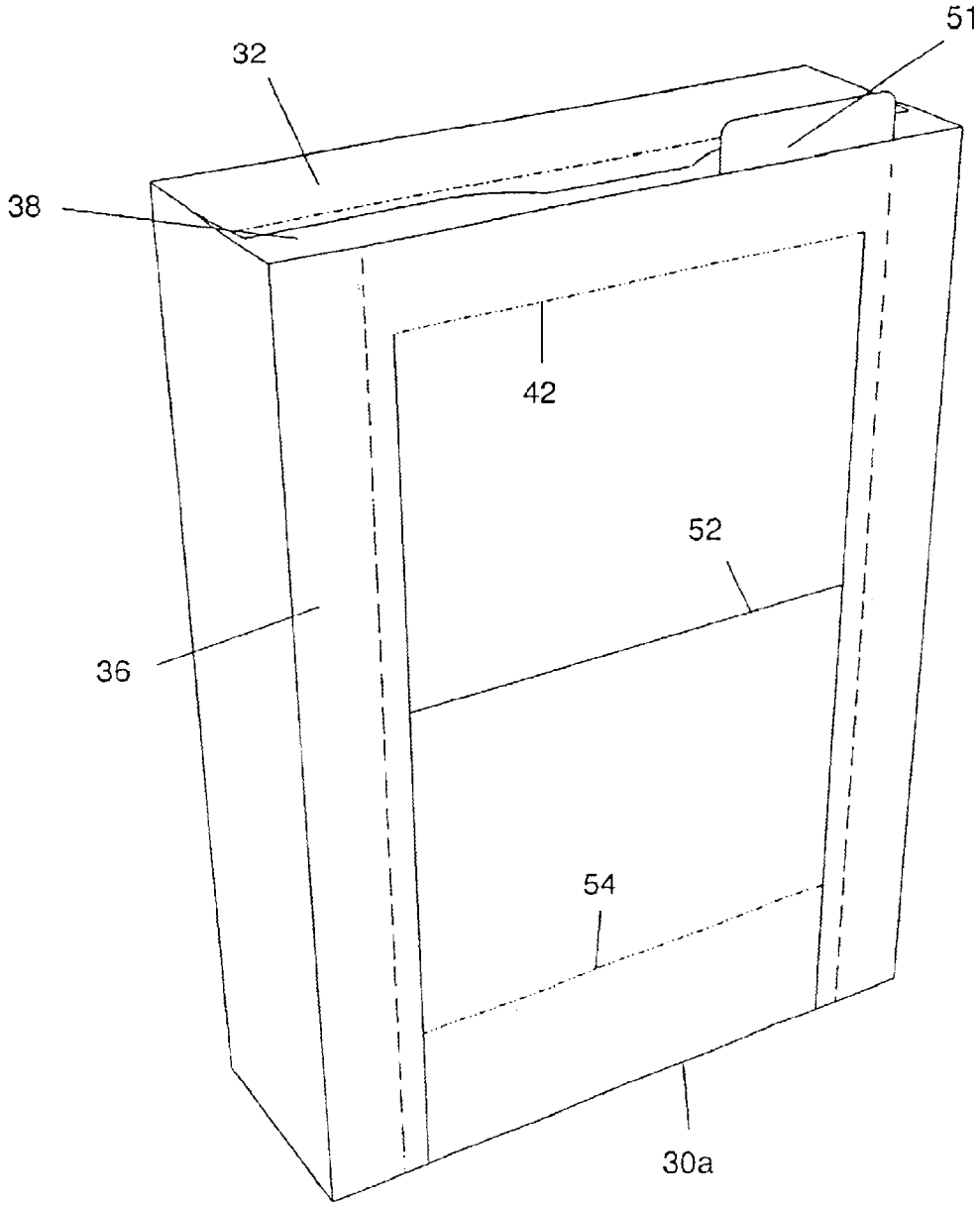
FIG. 5 is a perspective view showing a sealed carton standing upright.

Referring to FIG. 5, the tab 51 is shown as projecting above the top of the container, the folded tabs 32.

Figure 8:
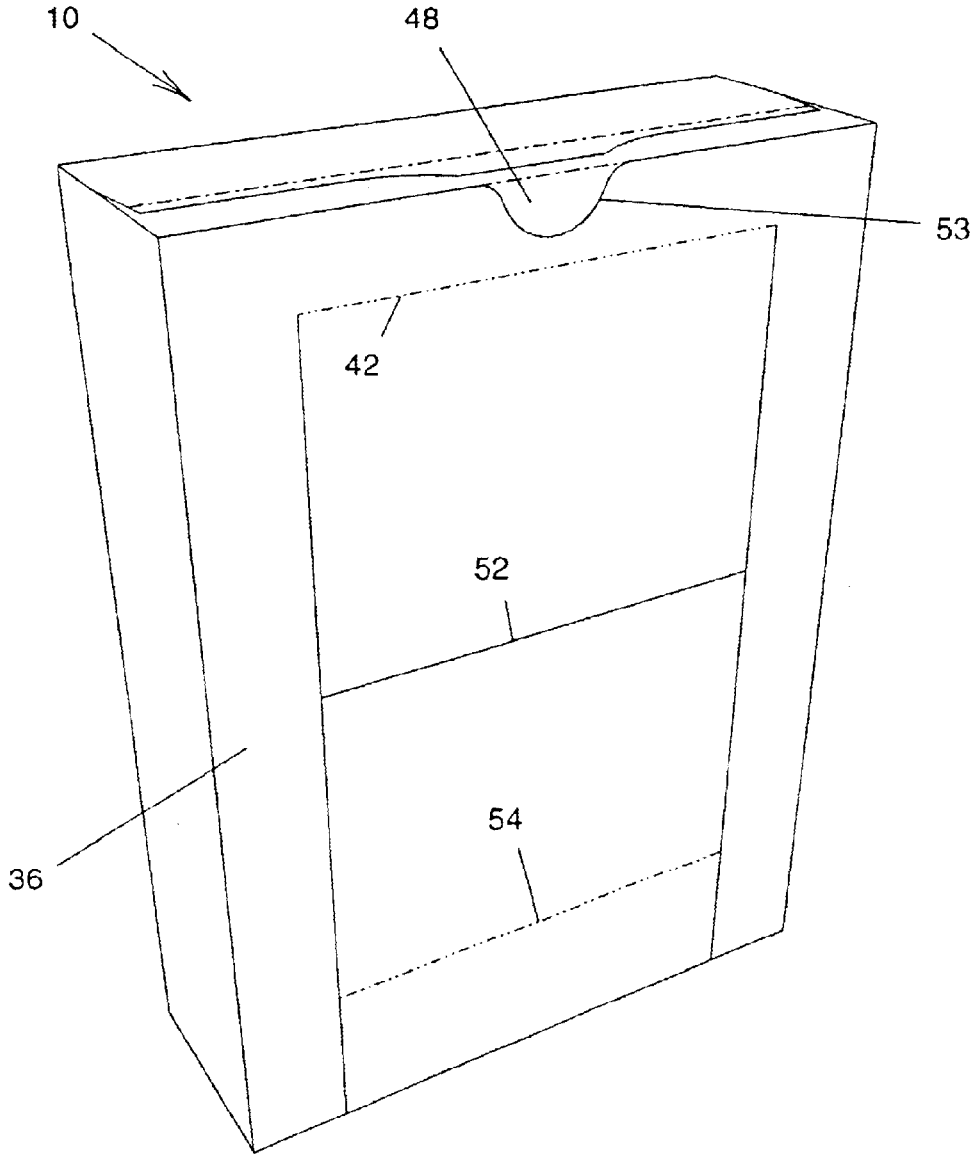
FIG. 8 is a perspective view showing a sealed carton with a flush slide panel.
Figure 9:
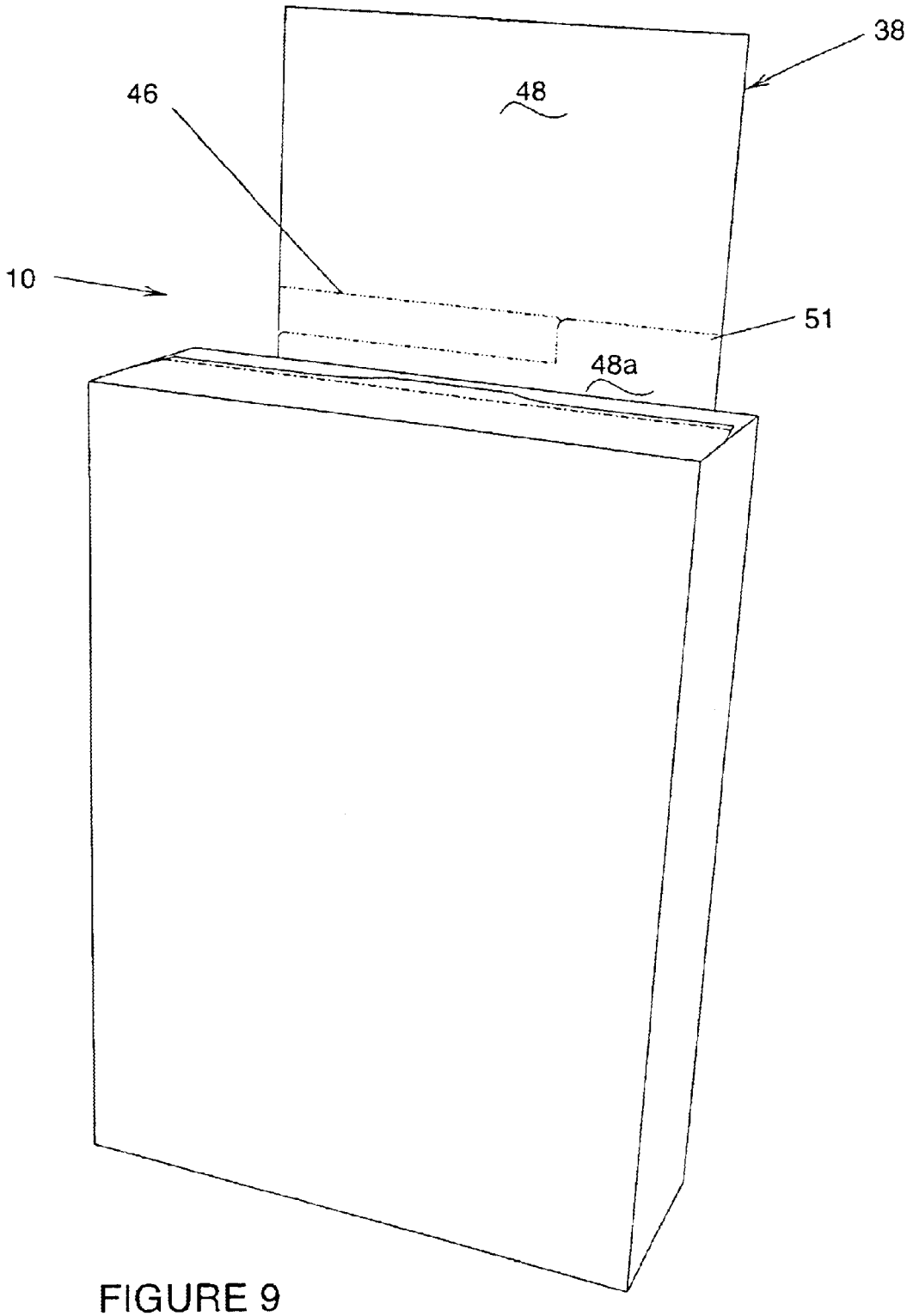
FIG. 9 is a perspective view of the carton configuration of FIG. 8 in an extended position.
Figure 10:
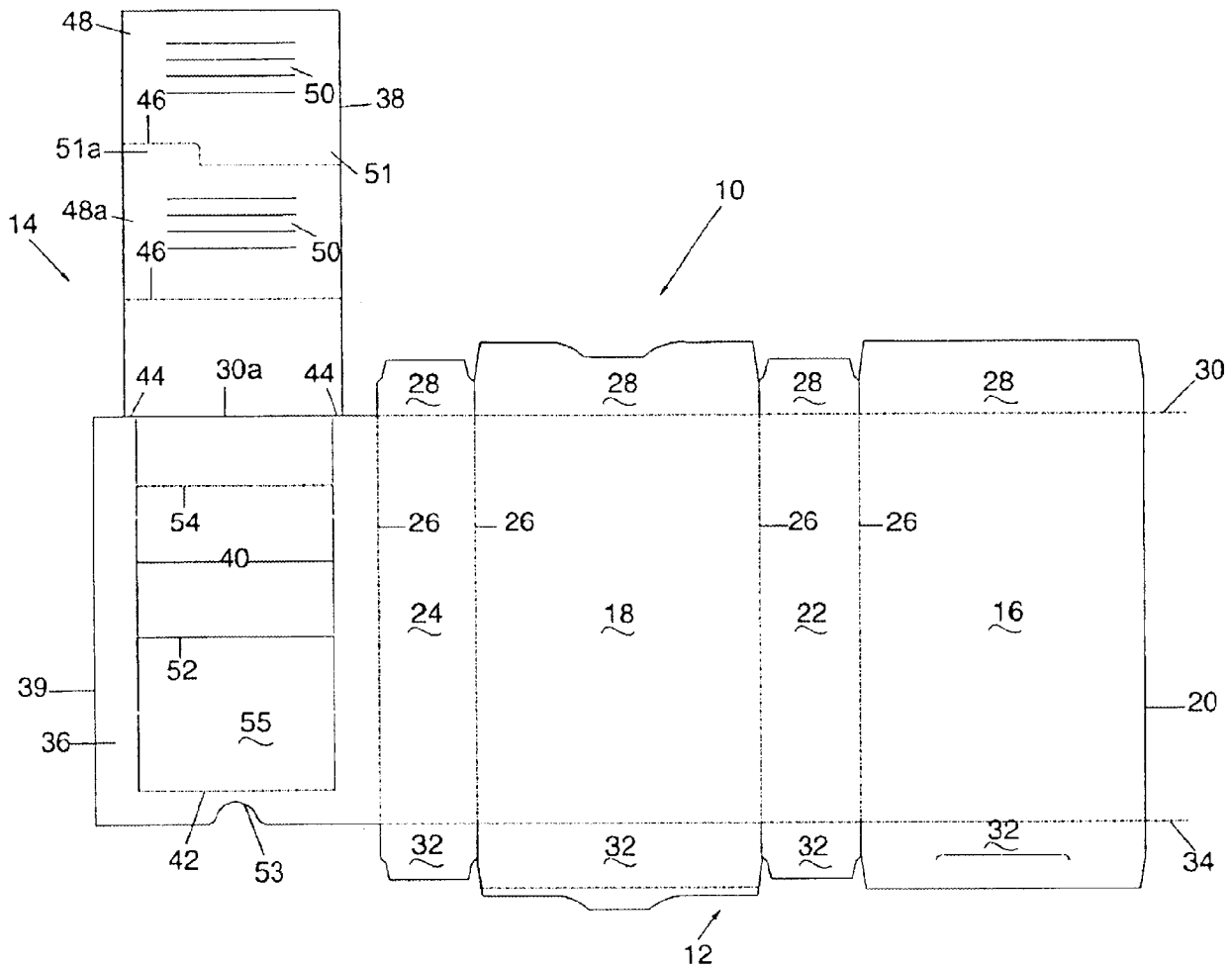
FIG. 10 is a plan view of a blank for forming the carton configuration of FIGS. 8 and 9.

Referring to FIGS. 8, 9 and 10, it is understood the slide panel 38 can be sized such that a top edge of the tab 51, or panel 48, is substantially coplanar with the top of the container 10.

Referring to FIG. 8, access to the slide panel 38, for moving the slide panel can be provided by a recess 53 in the adjacent portion of the major panel 36.

Thus, the present carton 10 can be formed to have the tab 51 project above the top of the carton, or the top of the slide panel 38 can be flush with the top of the carton.

Further, in the flush configuration of FIGS. 8–10, the slide panel 38 can still provide a first portion 48 having the index tab 51. Specifically, the index tab 51 can be formed by perforation lines within the slide panel 38, such that upon separation of the first portion 48 from the slide panel, the separated portion includes the index tab 51. That is, an upper edge of the first portion 48 can be substantially linear along the top of the carton 10, wherein the tab 51 is formed along the separation line with a second portion 48*a*.

In addition, if the slide panel 38 is formed with spaced perforation lines 46, the second portion 48*a* can be removed, wherein both the first portion 48 and the second portion 48*a* include index tab 51, 51*a* respectively. The index tab 51, 51*a* for each of the portions 48, 48*a* can be formed by a common perforation line that extends across the slide panel 38.

Accordingly, it should be appreciated that the present invention accomplishes its intended objects in providing a package having a portion that can be easily removed and archived without accessing or otherwise compromising the integrity of the container. The invention further provides a package having a slide panel with a separable portion that is removable from the container without compromising the integrity of the container, and a blank for forming the container including an integral slide portion having a separable portion.

Having described the invention in detail, what is claimed as new is:

1. A product package with a removable display panel comprising:

a) a sealable package sized to encompass a product, the package having a flat side with an interior surface and an exterior surface;

b) a slide panel disposed against the exterior surface of the flat side, the slide panel having an end tethered to the exterior surface and a free end and the slide panel being slidable along an axis of the package in a plane parallel to the plane of the flat side between a first position laying within the foot print of the flat side and a second position exposing a portion of the slide panel out from the foot print of the flat side; and c) the slide panel having a line of weakness extending in a direction transverse the axis of the package, the portion of the slide between the line of weakness and a free edge of the slide panel comprising a removable portion and the line of weakness facilitating the separation of the removable portion of the slide panel from the flat side.

2. A product package as in claim 1, wherein the slide panel is slidably disposed between the exterior surface and a major panel adhered to the exterior surface.

3. A product package as in claim 2, wherein the major panel has a footprint generally consistent with the size and shape of the flat side and comprises an exterior surface of the package.

4. A product package as in claim 2, wherein the major panel has a pair of parallel cuts extending inward from a lower edge to a transverse fold line and the slide panel is foldably connected to the portion of the major panel between the cut lines at the lower edge.

5. A produce package as in claim 4, wherein the slide panel is narrower than the width of the major panel and wider than the distance between the two parallel cuts.

6. A product package as in claim 5, wherein the major panel between the cuts has three transverse fold lines allowing a section of the major panel to buckle outwardly upon the movement of the slide panel from the first position to the second position.

7. A product package as in claim 6, wherein the major panel between the cuts extending from the lower edge to one of the three transverse fold lines most adjacent the lower edge is adhered to the slide panel.

8. A product package as in claim 1, wherein the removable portion of the slide pane contains indicia representing one of a recipe, coupon or collectable.

9. A product package as in claim 1, including a file tab on the free end of the slide panel.

10. A product package as in claim 1, wherein the slide panel is slidably disposed between the exterior surface and a major panel adhered to the exterior surface, the major panel having a footprint substantially consistent with the size and shape of the flat side and the major panel comprising an external surface of the product package.

11. A product package with a removable display panel comprising:

a) a sealable package sized to encompass a product, the package having a flat side with an inner and an outer surface;

b) an external panel defining at least a portion of the exterior surface of the container fixed to the flat side, the external panel having top and bottom transverse edges and a free section that is movable from the plane of the external panel, the free section being oriented along a package axis and extending from the bottom edge of the external panel to a first transverse fold line adjacent the top edge;

c) a slide panel disposed between the external panel and the flat side, the slide panel having a footprint narrower than the external panel and wider than the free section, and the slide panel having a bottom end foldably connected to the free section along a bottom edge of the free section;

d) the slide panel being slidable from between the external panel and the flat side in the direction of the axis of the package from a first position within the foot print of the external panel to a second position exposing a portion of the slide panel out from the foot print of the external panel; and e) the slide panel having a line of weakness extending in a direction transverse the axis of the package, the portion of the slide between the line of weakness and a free edge of the slide panel comprising a removable portion and the line of weakness facilitating the separation of the removable portion of the slide panel from the flat side.

12. A product package as in claim 11, wherein the free section has second and third transverse fold lines each parallel to the first transverse fold line, the second fold line being equal distant from each of the first and third fold lines.

13. A product package as in claim 12, wherein the free section between the bottom edge of the free section and the third fold line is adhered to the slide panel.

14. A product package as in claim 13, wherein the free section is foldable along the three transverse fold lines in a direction outward from the plane of the external panel responsive to the slide panel moving to the second position.

15. A product package as in claim 11, wherein the slide panel has an upper end and a file tab extending from the upper end.

16. A product package as in claim 11, wherein the removable portion of the slide panel includes indicia representing one of a recipe, coupon or collectable.

17. A product package as in claim 11, wherein the slide panel has a second line of weakness extending in a direction transverse the axis of the package defining a second removable portion and the second line of weakness facilitating the separation of the second removable portion of the slide panel from the flat side.

18. A blank for a paperboard container having a removable display portion comprising:

a) a first portion cut and scored with orthogonal fold lines to define panels that are foldable to form a rectangular carton having a front, back, opposite sides, a top and a bottom;

b) a second portion including a major panel connected to the first portion along a fold line that corresponds to a side edge of the carton and a minor panel connected to the major panel along a transverse fold line that corresponds to a first bottom edge of the carton, the major panel being of a size generally consistent with the footprint of the front and back of the carton and the minor panel being narrower than the footprint of the front and back of the carton;

c) the major panel including two cuts extending inward from the transverse fold line and parallel to the fold line corresponding to a side edge of the carton, the cuts terminating in a second transverse fold line; and d) the minor panel having at least one transverse line of perforations extending generally parallel td the fold line corresponding to the first bottom edge.

19. A blank as in claim 18 wherein the width of the minor panel is greater than the distance between the two parallel cuts.

* * * * *

UNITED STATES PATENT AND TRADEMARK OFFICE

CERTIFICATE OF CORRECTION

PATENT NO. : 6,892,876 B1 
DATED : May 17, 2005
INVENTOR(S) : Aubry, Bethany A. et al.

It is certified that error appears in the above-identified patent and that said Letters Patent is hereby corrected as shown below:

Column 7,
Line 11, delete “pane” and replace with -- panel --.

Column 8,
Line 4, delete “equal distant” and replace with -- equi-distant --.
Line 46, delete “td” and replace with -- to --.

Signed and Sealed this

Twenty-fifth Day of April, 2006

JON W. DUDAS
*Director of the United States Patent and Trademark Office*